United States Patent [19]

Trombetti-Dickens

[11] Patent Number: 4,924,528

[45] Date of Patent: May 15, 1990

[54] NURSING BIB

[76] Inventor: Pamela Trombetti-Dickens, 8064 Cammeray Ct., Citrus Heights, Calif. 95610

[21] Appl. No.: 281,064

[22] Filed: Dec. 8, 1988

[51] Int. Cl.[5] ..... A41B 13/10; A41D 1/00; A41D 1/20

[52] U.S. Cl. ..... 2/104; 2/49 R; 2/46

[58] Field of Search ..... 2/49 R, 49 A, 48, 50, 2/51, 52, 104, 46

[56] References Cited

U.S. PATENT DOCUMENTS

| | | | |
|---|---|---|---|
| 760,142 | 5/1904 | Nelson | 2/119 |
| 1,503,983 | 8/1924 | Clements | 2/ |
| 2,767,403 | 10/1956 | Givens | 2/49 R |
| 2,822,548 | 2/1958 | Rhonmine | 2/49 A |
| 2,870,447 | 1/1959 | Pitcock | 2/52 X |
| 3,115,638 | 12/1963 | Kikas | 2/48 |
| 3,115,639 | 12/1963 | Moszczynski | 2/48 |
| 3,286,279 | 11/1966 | Brown | 2/49 R |
| 3,601,815 | 8/1971 | Strehlan | 2/48 |
| 3,984,876 | 10/1976 | Sutton | 2/48 |
| 3,995,321 | 12/1976 | Johnson | 2/49 R |
| 4,569,086 | 2/1986 | Takefman | 2/49 R |
| 4,651,349 | 3/1987 | Heiler | 2/104 |
| 4,660,225 | 4/1987 | Kahn | 2/49 R |
| 4,663,779 | 5/1987 | Bible | 2/49 R |
| 4,710,979 | 12/1987 | Bull et al. | 2/48 |

*Primary Examiner*—Werner H. Schroeder
*Assistant Examiner*—Jeanette E. Chapman
*Attorney, Agent, or Firm*—Joseph E. Gerber

[57] ABSTRACT

A bib garment for covering a mother's nursing baby is disclosed which incorporates a primary panel having its upper edge shaped to fit the neck of the nursing mother, the panel being long and wide enough to cover the front and sides of the mother and her baby while nursing. Pockets are disposed adjacent the lower edge on the inside face of the bib for storage of and access to nursing necessities and equipment. Embellishments for enhancement of appearance, and detraction of attention from the nursing act, are disposed upon the face of the bib.

9 Claims, 2 Drawing Sheets

NURSING BIB

BACKGROUND OF THE INVENTION

1. Field of the Invention

The present invention relates generally to bibs, and more specifically to a bib providing privacy and convenience for a mother and her baby while nursing.

2. Description of the Related Art

Nursing mothers agree that keeping a timely breast feeding routine is often a significant challenge when other obligations and schedules conflict with a baby's needs. Today's baby often has to share its mother's attention with a job, shopping, social activities and other time consuming matters. Thus, a session of nursing is sometimes a catch-as-catch-can affair. In one common scenario, the mother finds herself in a public place when the baby is hungry. In the past, decorum required a retreat from public view, perhaps to a rest room or other private place. Despite the more relaxed attitude toward nursing in public modernly enjoyed by busy American mothers, most continue to prefer maintenance of some level of modesty while attending to maternal duties. Therefore, feeding is often simply carried out under a blanket draped from the mother's shoulders down over the nursing child. However, this method risks somewhat more exposure of the nursing act than may be acceptable. For example, the position of a freely draped blanket may be caused to shift during the performance of certain hygienic duties carried out thereunder. And further, blankets have a tendency to slip off at particularly inopportune moments.

Often, it is also necessary to have such items as tissues or towels, nursing pads for prevention of dampening of the brassiere, and perhaps baby bottles close at hand. It is further desireable to store this equipment in a way such that it remains accessible and ready for use without exposing it to the view of others.

Various bibs are well known for the purpose of covering the front of the torso of a wearer. These normally serve a protective purpose, a particularly broad range of bib designs having been directed to keeping food off the wearer's clothing. Babies' bibs are perhaps most common. Some, as exemplified by babies' bibs disclosed in Takefman U.S. Pat. No. 4,569,086 and Johnson U.S. Pat. No. 3,995,321, include a pocket or trough across the bottom. However, even if these bibs were made in a size appropriate to cover a nursing mother's baby, they would be, at best, awkward and unsightly to use. Further, even if they were worn with their troughs to the inside, the equipment needed by a nursing mother could not be stored handily therein.

Bibs for adult use are also known, one example being an ornamental bib shown in Kahn U.S. Pat. No. 4,660,225. Kahn's bib is short and narrow, and therefore unsuitable for covering a nursing baby. Neither does is have pockets to hold needed accessories. Another bib, directed to use in feeding either children or the adult handicapped includes a trough across its bottom as shown in Bible U.S. Pat. No. 4,663,779. Bible's bib is made of stiff, clear plastic and is therefore unsuitable for privacy while nursing.

Adult torso coverings also include aprons, one example being the device disclosed in Bull, et al. U.S. Pat. No. 4,710,979, wherein detachable appliques picturing toy animals, and the like, are removably bound to the apron's front. Bull's apron has front and rear panels with cords to tie the apron securely around the torso of the wearer. Pockets are provided across the bottom of the front panel to hold appliques when detached. However, when the front and back panels of Bull's apron are bound snugly to the body of the wearer by their cords as in normal use, private nursing thereunder is not facilitated.

At least one prior device has addressed a few of the concerns and details to which a mother must attend while nursing. Heiler U.S. Pat. No. 4,651,349 discloses a breast feeding sling having a sleeve through which the mother's arm passes. Panels cover the mother's lap and baby, and a small pocket is provided for tissues. One apparent drawback of this device is that it binds one of the nursing mother's arms into a sleeve-like fabric loop at the lower edge of the sling, this appearing to be restrictive of movement.

None of the foregoing articles effectively permit a mother to nurse privately and comfortably within the view of others while retaining the ability to perform hygienic duties such as drying or cleaning the breasts and baby. Neither does any provide room enough underneath for operation of breast pump equipment and pockets for storage of baby bottles. Nor do any of the foregoing give the appearance that the mother is merely wearing a conventional article of clothing, thereby diverting attention from the fact that nursing is being carried out thereunder.

SUMMARY OF THE INVENTION

The nursing bib of the present invention is adapted to overcome the above noted shortcomings and to provide additional benefits for the nursing mother. In sum, the nursing bib disclosed herein is constructed to give the appearance that a nursing mother is wearing a conventional article of clothing, while retaining the function and utility needed in a garment directed to its special purpose.

The several elements of this inventive article include a broad fabric panel large enough to cover the chest and torso of a nursing mother and her baby. Its width is such that it prevents perception of the nursing act from all angles, and its length covers the area between the mother's neck and lap. In the preferred embodiment of the bib disclosed herein, the top edge of the panel is sculpted into two narrow extensions which attach behind the mother's neck thereby giving the bib support. Along the bottom edge of the inner face of the panel several pockets are disposed for easy storage of nursing towels, tissues, baby bottles, and the like. And, for a pleasing appearance approximating that of a more conventional garment, a collar and perhaps other embellishments such as lace trim, buttons, a bow and a pleasing print are disposed upon its face. These help produce a "camouflage" effect, thereby making the nursing act less obvious.

In one alternative embodiment of the inventive nursing bib, the neck area is merely sculpted into a loop to slip easily over the mother's head In another, a two-layer construction is employed.

Thus, it is an object of the present invention to provide a bib for covering a mother's nursing baby appearing to be a more conventional garment, thereby avoiding the attraction of attention and prying eyes.

It is a further object of the present invention to provide a garment for covering a nursing mother and her baby while allowing freedom of movement thereunder.

Still, a further object of the present invention is to provide a nursing garment wherein nursing equipment may be stored for easy and private accessibility while nursing.

It is yet a further object of the present invention to provide a nursing garment easy to don and doff.

Yet another object of the present invention is to provide a nursing garment that may be folded up and used for storage of nursing equipment between nursing sessions, said equipment being again easily accessible upon once again donning the garment.

Still further objects of the inventive nursing garment disclosed herein will be apparent from the drawings and the following description thereof.

DESCRIPTION OF THE PREFERRED EMBODIMENT

Figure 1:
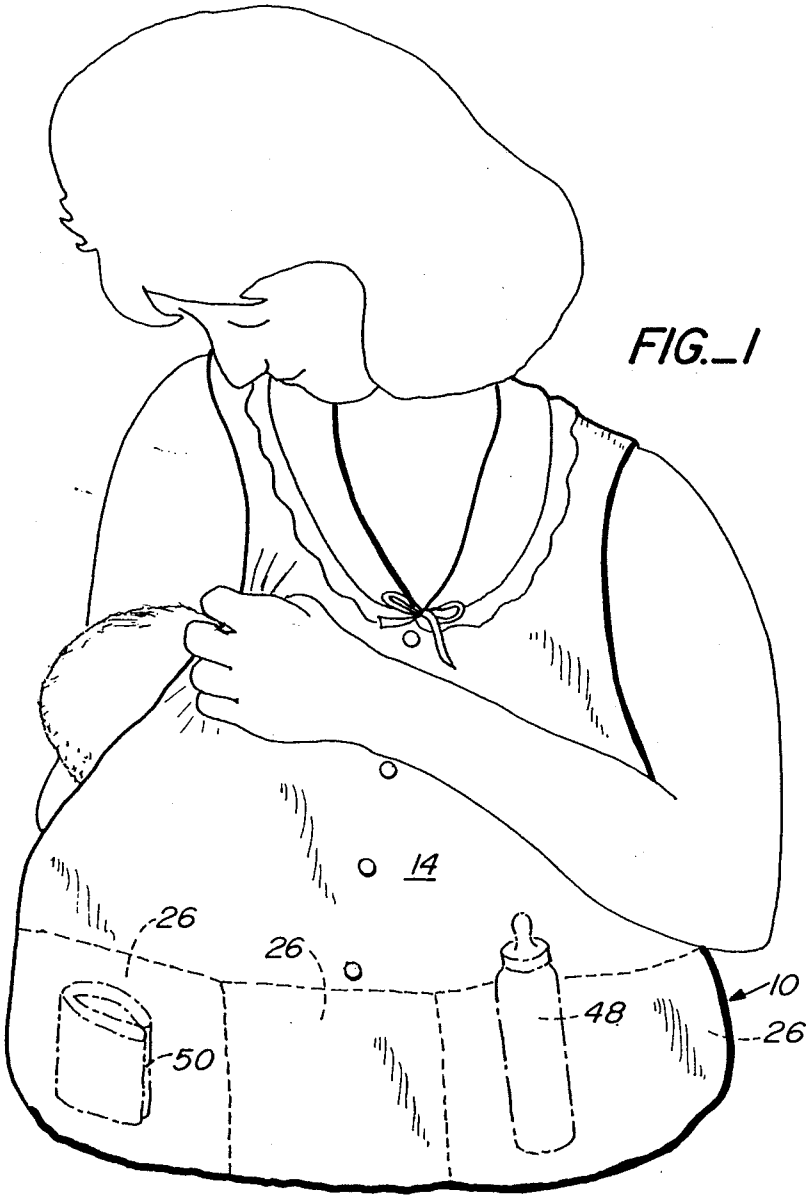
FIG. 1 is a view of a nursing mother with her baby beneath the inventive nursing bib, showing pockets containing nursing equipment underneath.
Figure 3:
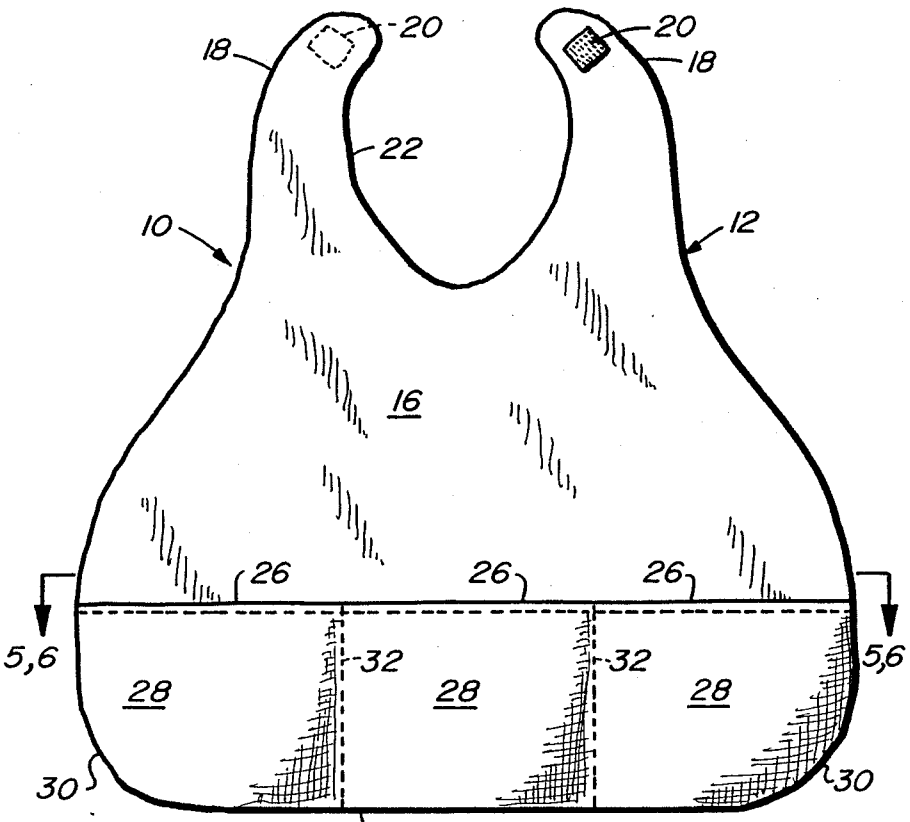
FIG. 3 is a rear elevational view of the nursing bib of FIG. 1 showing pockets for nursing equipment.
Figure 2:
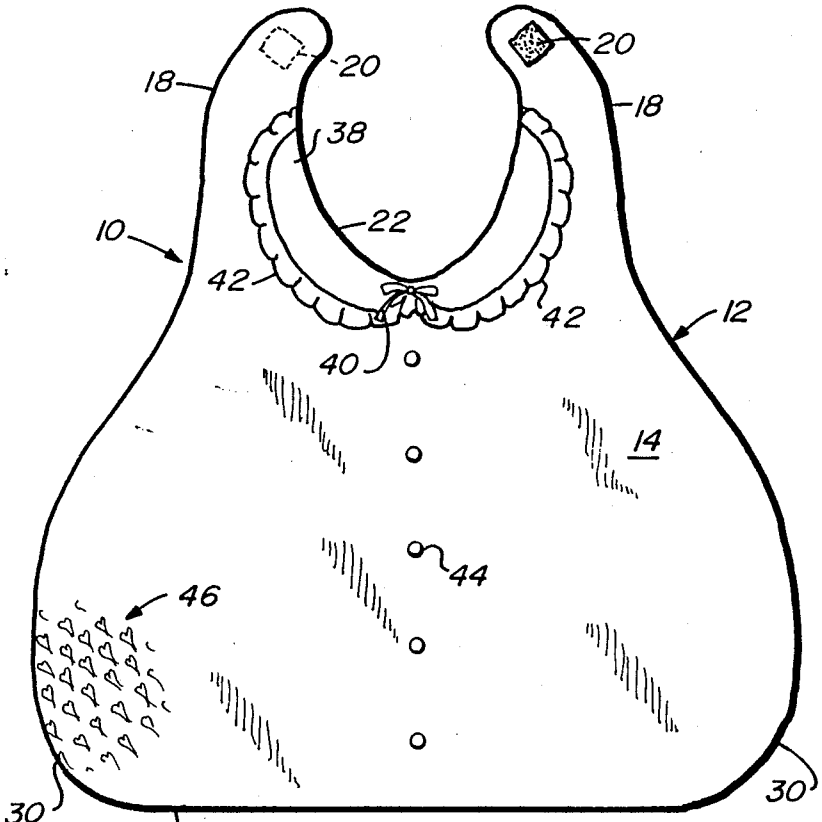
FIG. 2 is a front elevational view of the preferred embodiment of the inventive nursing bib.

Referring now specifically to the drawings FIGS. 1, 2 and 3 show the inventive nursing bib generally indicated by reference numeral 10. Said bib 10 is constructed of washable textile fabric. A blend of polyester and cotton has been found to work well, but other fabrics may also be used with success.

One preferred embodiment of bib 10 employs a single layer construction, the body of said bib being referred to herein and in the claims as the primary panel 12, said primary panel having an outer face 14 and an inner face 16. An alternative, double layered embodiment of bib 10 employing two fabric panels in primary panel 12 is disclosed below.

The upper portion of bib 10 is sculpted into a pair of narrow extensions to form neck straps 18, each having means at its end for fastening to the other behind the neck. Mating patches of mechanically interlocking fabric 20 such as are sold under the trademark VELCRO have been found to function satisfactorily, but other fastening means such as snaps, buttons or cord ties may also work as well for fastening neck straps 18. One of said mating fabric patches 20 is preferably affixed to outer face 14 of panel 12, and the other is preferably affixed to inner face 16 to assure that neck straps 18 lie flat when properly fastened. When straps 18 are fastened about the neck of the nursing mother, they define a neckline 22 of bib 10.

Figure 4:
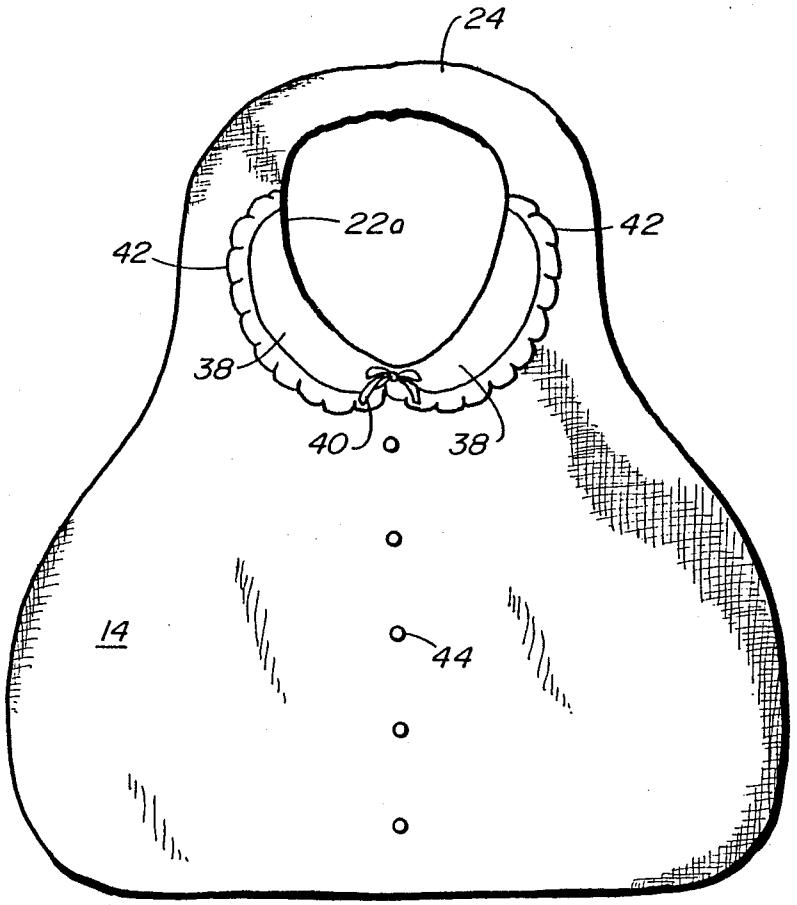
FIG. 4 is a plan view of an alternative embodiment of the present inventive nursing bib having a neck in the form of a closed loop.

In an alternative embodiment of bib 10, its upper portion is sculpted into a loop 24 with neckline **22*a* as best seen in FIG. 4**. The mother simply slips this loop over her head to don the garment.

If cut low enough, neckline 22 or **22*a* may function to provide the nursing mother an easy view of her baby, without compromising the privacy of the nursing act. The mother needs only to raise her free arm under bib 10 in order to peer discretely down upon her baby through the aperture defined by neckline 22 or 22*a*. Of course, as shown in FIG. 1, the mother may also view her nursing baby by simply pulling an edge of bib 10** aside in a discreet manner.

The lower portion of bib 10 is generally rectangular in shape, and much wider than the upper neck portion of said bib. The dimension of its length is preferably sufficient to extend from the neck to the lap of the nursing mother. The width of bib 10 is preferably such that it drapes to both sides of the nursing mother's torso area, thereby affording privacy from all lateral angles during the nursing act. This gives the lower portion of bib 10 a lobed appearance when examined in plan view as in FIGS. 2, 3 and 4.

For the purpose of carrying and storing for easy access such nursing necessities as tissues, towels, bottles and the like, a plurality of large pockets 26 are provided adjacent the lower edge of primary panel 12 on inner face 16 of same. See FIGS. 1, 3 and 5, generally. Pockets 26 are constructed from a narrow, generally rectangular fabric panel 28 of a width and shape matching the lower perimeter 30 of bib 10. Panel 28 may be cut to a vertical dimension adequate to give pockets 26 sufficient depth for holding standard nursing necessities. Pocket panel 28 is affixed to bib 10's bottom edge and lower side edges; that is, bib 10's lower perimeter 30. Thereby, a trough is formed which is in turn divided into a plurality of open-topped pockets 26 by one or more vertical seams 32 stitched through pocket panel 28 binding it to primary panel 12.

Figure 5:
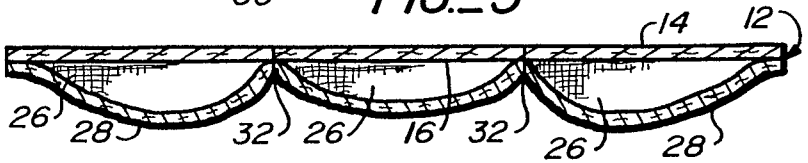
FIG. 5 is a horizontal sectional view, on line 5—5 of FIG. 3 showing the pockets on the inner face of the inventive nursing bib.
Figure 6:
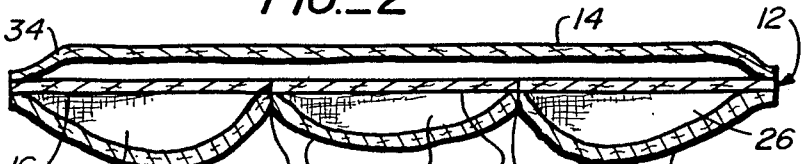
FIG. 6 is a horizontal sectional view, on line 6—6 of FIG. 3, showing the pockets on the inner face of an alternative two-layered embodiment of the inventive nursing bib.

In an alternative embodiment of the inventive bib, a double-layered construction is employed as shown in FIG. 6. Here, primary panel 12 is shown to be comprised of two separate fabric layers, in contrast to the above-described embodiment wherein panel 12 is a single layer as shown in FIG. 5. One fabric layer of panel 12 in this two-layered embodiment is facing panel 34, and the other is liner panel 36. Panels 34 and 36 are of like size and shape and are sewn to each other only around their edges. Further, the size and shape of each said panel are the same as in single-layered panel 12. Thus, together, panels 34 and 36 comprise primary panel 12 in this twolayered embodiment. Primary panel 12 still includes an outer face 14 and an inner face 16, as above, in this embodiment. However, here, instead of faces 14 and 16 being opposite surfaces of a single fabric layer, they are the outer, exposed faces of what is actually two separate pieces of fabric sewn together around their edges. That is, the exposed face of panel 34 is outer face 14 of the two-layered primary panel, and the exposed face of panel 36 is inner face 16. Being bound together, one face of panel 34 and one face of panel 36 necessarily remain hidden. Said hidden faces are unnumbered herein, as is the planar, bib-shaped space defined by, and between, said panels.

Inner face 16, i.e. the exposed face of liner panel 36 of the two-layered version of primary panel 12, is partially covered adjacent its lower periphery with pocket panel 28, as above. In this embodiment of the inventive bib, it is preferable that seams 32 be stitched only to liner panel 36. This avoids, to some extent, the deformation of the outer face of bib 10 normally caused by pulling forces present when nursing equipment is stored in pockets 26.

The presence of unsightly stitching lines on the face of bib 10 is also avoided. Thus, a more pleasing surface appearance of bib 10 may be maintained.

Those skilled in the art will realize that pockets 26 may also be made of individual patches of fabric affixed at their side and bottom edges to the inner face 16 of bib 10 without departing from the spirit of the invention.

To enhance the appearance of bib 10, and to cause it to resemble a more conventional article of clothing thereby minimizing the attention drawn to the nursing act, certain pleasant appearing embellishments are preferably deployed upon its outer face 14. To this end, the preferred embodiment of bib 10 has a collar 38 affixed to its neckline 22 or **22*a*. Collar 38 is important in helping to create the appearance of bib 10 being a more conventional garment. Other accoutrements found to cooperate in this effect include a bow 40 adjacent the lower extreme of neckline 22 or 22*a*, lace trim 42 around collar 38, buttons 44 running in a line down the front of outer face 14 and perhaps a pleasing decorative pattern in the fabric such as surface print 46 on outer face 14. Solid colored fabrics result in a pleasing appearance, although surface print 46 further minimizes the attention-attracting impression that the nursing mother is draped in a stark frock reminiscent of hospital garb. Therefore, print 46, as well as collar 38, bow 40, lace collar trim 42, and buttons 44** individually, and in cooperation produce an inventive "camouflage" effect that results in more privacy for a mother nursing within the view of others.

In use, when the nursing mother finds it necessary to breast feed her baby within the view of others, she merely lays the baby upon her lap, unfolds bib 10 and slips it around her neck. After spreading bib 10 over her baby, the mother may undo her bodice, lift the baby to her breast, and commence nursing in privacy, as in FIG. 1. While nursing, as towels, tissues or nursing pads are needed the mother will find them easily accessible in pockets 26. It is, of course, most convenient and private if these items have been readied in the pockets beforehand. Further, if it becomes necessary to draw milk from the breast for later feedings by bottle, equipment directed to that purpose may be operated privately under bib 10, whether or not the baby is present. The pockets are equally useful for storage of such equipment as baby bottle 48 and towel 50, before, during and after such a session.

When nursing and its related hygienic duties are complete, the mother merely slips bib 10 from around her neck and folds it up with the contents of the pockets remaining privately inside. At some later time she may remove any soiled articles from the pockets, wash the bib if necessary and restock its pockets with fresh, clean accessories. The bib may then be folded and stowed so that next time the mother dons it these fresh, clean items are again privately close at hand.

The foregoing detailed disclosure of the inventive bib garment 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this inventive bib may later be realized. Accordingly, the scope of the invention should be determined with reference to the appended claims, and not by the examples which have herein been given.

What is claimed is:

1. A nursing mother's bib of washable textile fabric for covering her nursing baby comprising, in combination:

a. a primary panel, having outer and inner faces, of sufficient length to cover the area between the mother's neck and lap, and of sufficient width to afford complete privacy from all lateral angles while nursing, said primary panel being comprised of two similarly-shaped, edge-bound fabric layers, a facing panel and a liner panel, each having an exposed face, said exposed faces being, respectively, said outer and inner faces of said bib:

b. an upper edge on said primary panel shaped to fit the neck of the nursing mother, said neck fitting edge comprising two narrow extensions from the upper edge of said primary panel; and c. a plurality of open-topped pockets disposed upon said bib's inner face adjacent its lower edge.

2. The bib of claim 1, wherein said pockets are bound only to said liner panel.

3. The bib of claim 1, wherein said upper edge extensions bear means for attachment to one another on their terminal ends.

4. The bib of claim 1, further comprising a collar disposed upon said primary panel's outer face adjacent said neck fitting edge.

5. The bib of claim 1, further comprising a row of buttons disposed centrally upon its outer face.

6. A nursing mother's bib of washable textile fabric covering her nursing baby comprising:

a. a primary panel, having outer and inner faces, of sufficient length to cover the area between the mother's neck and lap, and of sufficient width to afford complete privacy from all lateral angles while nursing, said primary panel further including an upper edge shaped to fit the neck of the nursing mother, said neck fitting edge consisting of a closed loop of fabric integral with the upper edge of said panel;

b. two similarly-shaped, edge-bound fabric layers, a facing panel and a liner panel each having an exposed face, said exposed faces being, respectively, the outer and inner faces of said bib; and, c. a plurality of pockets disposed upon said inner face adjacent its lower edge.

7. The bib of claim 6, wherein said pockets are bound only to said liner panel.

8. The bib of claim 6, further comprising a collar disposed upon said primary panel's outer face adjacent said neck fitting edge.

9. The bib of claim 6, further comprising a row of buttons disposed centrally upon its outer face.

* * * * *